US011041367B2

(12) United States Patent
Al-Quwaisim et al.

(10) Patent No.: US 11,041,367 B2
(45) Date of Patent: Jun. 22, 2021

(54) SYSTEM AND METHOD FOR OPERATING INFLOW CONTROL DEVICES

(71) Applicant: Saudi Arabian Oil Company, Dhahran (SA)

(72) Inventors: Hussain A. Al-Quwaisim, Abqaiq (SA); Fahad M. Al-Shammary, Abqaiq (SA); Fowzi O. Al-Shammari, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/694,522

(22) Filed: Nov. 25, 2019

(65) Prior Publication Data

US 2021/0156227 A1 May 27, 2021

(51) Int. Cl.

| | |
|---|---|
| ***E21B 34/16*** | (2006.01) |
| ***E21B 23/01*** | (2006.01) |
| ***E21B 43/14*** | (2006.01) |
| ***E21B 47/06*** | (2012.01) |
| ***E21B 47/07*** | (2012.01) |
| ***E21B 21/08*** | (2006.01) |

(Continued)

(52) U.S. Cl.

CPC ..... *E21B 34/16* (2013.01); *E21B 23/01* (2013.01); *E21B 21/08* (2013.01); *E21B 21/10* (2013.01); *E21B 43/12* (2013.01); *E21B 43/14* (2013.01); *E21B 47/06* (2013.01); *E21B 47/07* (2020.05); *E21B 2200/06* (2020.05)

(58) Field of Classification Search

CPC ..... E21B 34/16; E21B 23/01; E21B 2200/06; E21B 47/07; E21B 43/14; E21B 47/06; E21B 21/08; E21B 21/10; E21B 43/12

See application file for complete search history.

(56) References Cited

U.S. PATENT DOCUMENTS

| | | |
|---|---|---|
| 3,665,955 A | 5/1972 | Conner, Sr. |
| 5,309,988 A | 5/1994 | Perry et al. |

(Continued)

OTHER PUBLICATIONS

Areepetta Mannil A., et al.,"An Improved Method for Shifting Sliding Sleeves on ICD Screen Completions in Extended- and Mega-Reach Applications Combining a Novel Shifting Tool with Coiled Tubing Well Tractor Technology", Society of Petroleum Engineers.

(Continued)

*Primary Examiner* — Tara Schimpf
*Assistant Examiner* — Manuel C Portocarrero
(74) *Attorney, Agent, or Firm* — Bracewell LLP; Constance G. Rhebergen

(57) ABSTRACT

An inflow control device ("ICD") is in production tubing in a wellbore, and used to control a flow of fluid through the ICD. The ICD is adjustable in response to an external force, which is selectively applied by an actuator that is included with a bottom-home assembly ("BHA"). The BHA is deployed on coiled tubing, and anchored in the wellbore to isolate the coiled tubing from resultant or counter forces generated when adjusting the ICD. Fluid is optionally injected into the coiled tubing on surface, and directed into the wellbore from the BHA. A latching arm is included with the actuator, which is equipped with a profile that matches a profile on the ICD to facilitate engagement between the arm and the ICD.

20 Claims, 5 Drawing Sheets

(51) Int. Cl.
*E21B 21/10* (2006.01)
*E21B 43/12* (2006.01)

(56) References Cited

U.S. PATENT DOCUMENTS

| | | | | |
|---|---|---|---|---|
| 6,494,264 | B2 | 12/2002 | Pringle et al. | |
| 6,679,334 | B2 | 1/2004 | Johnson et al. | |
| 6,938,708 | B2 | 9/2005 | Bloom et al. | |
| 7,150,318 | B2 * | 12/2006 | Freeman | E21B 34/14 166/255.1 |
| 7,156,169 | B2 | 1/2007 | Bartlett | |
| 7,273,106 | B2 | 9/2007 | Huckabee et al. | |
| 7,900,705 | B2 | 3/2011 | Patel | |
| 9,163,481 | B2 | 10/2015 | Noske et al. | |
| 9,175,518 | B2 | 11/2015 | Kotonis et al. | |
| 2004/0035591 | A1 | 2/2004 | Echols | |
| 2006/0196668 | A1 | 9/2006 | Burge et al. | |
| 2013/0020088 | A1 * | 1/2013 | Dyer | E21B 34/063 166/373 |
| 2013/0062073 | A1 | 3/2013 | Landsiedel | |
| 2017/0342804 | A1 | 11/2017 | Poluchalla et al. | |
| 2018/0171751 | A1 | 6/2018 | Watson | |
| 2018/0223625 | A1 | 8/2018 | Noel | |
| 2018/0252073 | A1 | 9/2018 | Richards et al. | |
| 2019/0055814 | A1 | 2/2019 | Frosell et al. | |

OTHER PUBLICATIONS

Darceuil, N., et al.,"Multi-Tasking Valve MTV Technology Optimizing Operations for Challenging ICD's Liner Installation in ADMA-OPCO", Abu Dhabi, UAE. Society of Petroleum Engineers. doi:10.2118/183039-MS, Nov. 7, 2016.

Jungseo Park et al., "An Improved Method of Computing Heating Information for Triangle Heating for an Automated Thermal Forming System", journal of Ship Production and Design, vol. 34, No. 3, Aug. 2018, pp. 181-190.

PCT Search Report dated Feb. 18, 2021, in the prosecution of patent application No. PCT/US2020/061698, 8 pages.

* cited by examiner

SYSTEM AND METHOD FOR OPERATING INFLOW CONTROL DEVICES

BACKGROUND OF THE INVENTION

1. Field of Invention

The present disclosure relates to controlling flow in a wellbore. More specifically, the present disclosure relates to controlling flow in a wellbore by manipulating inflow control devices with a bottom-hole assembly having a means for generating a manipulating force. Yet more specifically, the present disclosure relates to applying a bi-directional manipulating force from a bottom-hole assembly to open or close inflow control devices.

2. Description of Prior Art

Wellbores for the production of hydrocarbon are typically open hole or lined with casing, For cased wellbores, they are usually perforated adjacent a producing or formation zone. Fluid produced from the zone is typically directed to surface within production tubing that is inserted within the casing. Formation fluids generally contain one or more of stratified layers of gas, liquid hydrocarbon, and water. Boundaries between these three layers are often not highly coherent, thereby introducing difficulty for producing a designated one of the fluids. Also, some formations have irregular rock properties or defaults that cause production to vary along the length of the casing. It is usually desired that the fluid flow rate remain generally consistent inside the formation to control the hydrocarbons and water movement for strategic prolonged production.

A fluid flow rate from one formation (or segment of the formation) that varies within the casing may inadvertently cause production from another zones or zones, or produces unnecessary amounts of water from high potential segments or zones; which is undesirable because it can lead to a water breakthrough inside the formation which often results in trapped unproduced hydrocarbons. To overcome this challenge and to control frictional losses in wells, an inflow control device ("ICD") is sometimes run in the wellbore as part of a lower completion connected to the production tubing. The ICD is useful for controlling fluid flow into the wellbore by controlling pressure drop across each zone. Multiple fluid flow devices may be installed, each controlling fluid flows along a section of the wellbore. These fluid control devices may be separated from each other by conventional packers. Other benefits of using fluid control devices include increasing recoverable reserves, minimizing risks of bypassing reserves, and increasing completion longevity. Usually a profiled is formed within each ICD to provide a latching surface for engagement and actuating the ICD. Sometimes the force required to actuate an ICD rises sharply, and may be sufficient to buckle coiled tubing applied in compression in an attempt to operate the ICD.

SUMMARY OF THE INVENTION

Disclosed herein is an example of an intervention system for use in a wellbore, and which includes coiled tubing selectively inserted within production tubing disposed in the wellbore, and a bottom-hole assembly that is selectively moveable adjacent to an inflow control device coupled with the production tubing. In this example the bottom-hole assembly includes a housing coupled with coiled tubing, an arm having a portion that is coupled with the housing, and a profiled portion distal from the housing that is selectively moved into engagement with a profile on the inflow control device, and an anchor coupled with the housing that is selectively engaged with sidewalls of the production tubing to define a path along which a force resulting from engagement between the profiled portion of the arm and the profile on the inflow control device is transferred. A nozzle is optionally included that has an inlet in communication with the coiled tubing, and an exit in communication with the inflow control device to define a fluid flow path between the coiled tubing and the inflow control device. Embodiments exist where the ICD is part of a lower completion of the production tubing, and where a data logger is provided with the coiled tubing. In an alternative, the housing further includes a motor that is coupled to the arm, so that when the motor is energized the profiled portion of the arm is selectively moved into engagement with the profile on the inflow control device. An option in this example is that the inflow control device is made up of a body, a valve member moveable within the body, and a port formed radially through a side wall in the body, where the profile on the inflow control device is formed on the valve member, and an inside of the production tubing is in fluid communication with sidewalls of the wellbore through the port. Another option in this example, is that the inflow control device is in an open configuration when the valve member is spaced away from the port, the inflow control device is in a flow control configuration when the valve member is set adjacent a portion of the port, the inflow control device is in a closed configuration when the valve member is adjacent all of the port, and the inflow control device is selectively moved between each of the open, flow control, and closed configurations by energizing the motor. In an example, the housing further contains an anchor motor that is coupled to the anchor, so that when the motor is energized the anchor is selectively moved into anchoring engagement with the sidewalls of the production tubing. In an alternate embodiment, the bottom-hole assembly further has a power source in the housing that selectively provides energy used to actuate the arm and the anchor. Optionally, a portion of the coiled tubing distal from the housing mounts to a reel disposed outside of the wellbore. In one example, disengaging the profiled portion of the arm with the profile on the inflow control device frees the bottom-hole assembly to move within and out of the wellbore.

Another example of an intervention system for use in a wellbore is disclosed, and which includes coiled tubing having a deployed end selectively inserted into production tubing that is installed within the wellbore, a housing attached to the deployed end, an actuator coupled with the housing and equipped with a portion indented with a pattern to define an actuator profile that is selectively engaged with an inflow control device profile, and an anchor coupled with the housing and that is selectively moved between a retracted configuration adjacent the housing, and a deployed configuration radially outward from the housing and into anchoring engagement with an inner surface of the production tubing. Optionally included with this embodiment of the intervention system is a monitoring system in the housing that is responsive to conditions in the wellbore that include temperature, pressure, and depth. In an alternative, the actuator profile is changeable to correspond to the inflow control device profile.

A method of intervening in a wellbore is also disclosed, and which includes handling an intervention system having a portion disposed inside of production tubing that is inserted in the wellbore, and where the intervention system includes a string of coiled tubing, and a bottom-hole assembly that is attached to the coiled tubing. The method of this example also includes adjusting a flow configuration of an inflow control device coupled with the production tubing with the bottom-hole assembly and isolating the coiled tubing from a force resulting from the step of adjusting by securing the bottom-hole assembly to the production tubing. In an alternative, the force is a resultant force, and wherein adjusting a flow configuration of an inflow control device involves engaging complementary profiles on the bottom-hole assembly and inflow control device and applying an adjustment force from the bottom-hole assembly to the inflow control device so that a flow of fluid through the inflow control device is adjusted. In an embodiment the adjustment force is generated within the bottom-hole assembly. Optionally included with the method is conditioning the wellbore by discharging fluid from the bottom-hole assembly that flows downhole inside the coiled tubing. Examples exist where the fluid that flows downhole inside the coiled tubing is acid. A cross section of a bore inside the coiled tubing is optionally filled entirely with the fluid. In an alternate example, the inflow control device is a first inflow control device, the method further involving moving the bottom-hole assembly to a location in the production tubing that is spaced away from the first inflow control device and adjacent to a second inflow control device, engaging the second inflow control device with the bottom-hole assembly, and adjusting a flow configuration of the second inflow control device. Moving the bottom-hole assembly optionally includes manipulating the coiled tubing.

BRIEF DESCRIPTION OF DRAWINGS

Some of the features and benefits of the present invention having been stated, others will become apparent as the description proceeds when taken in conjunction with the accompanying drawings, in which.

Figure 1:
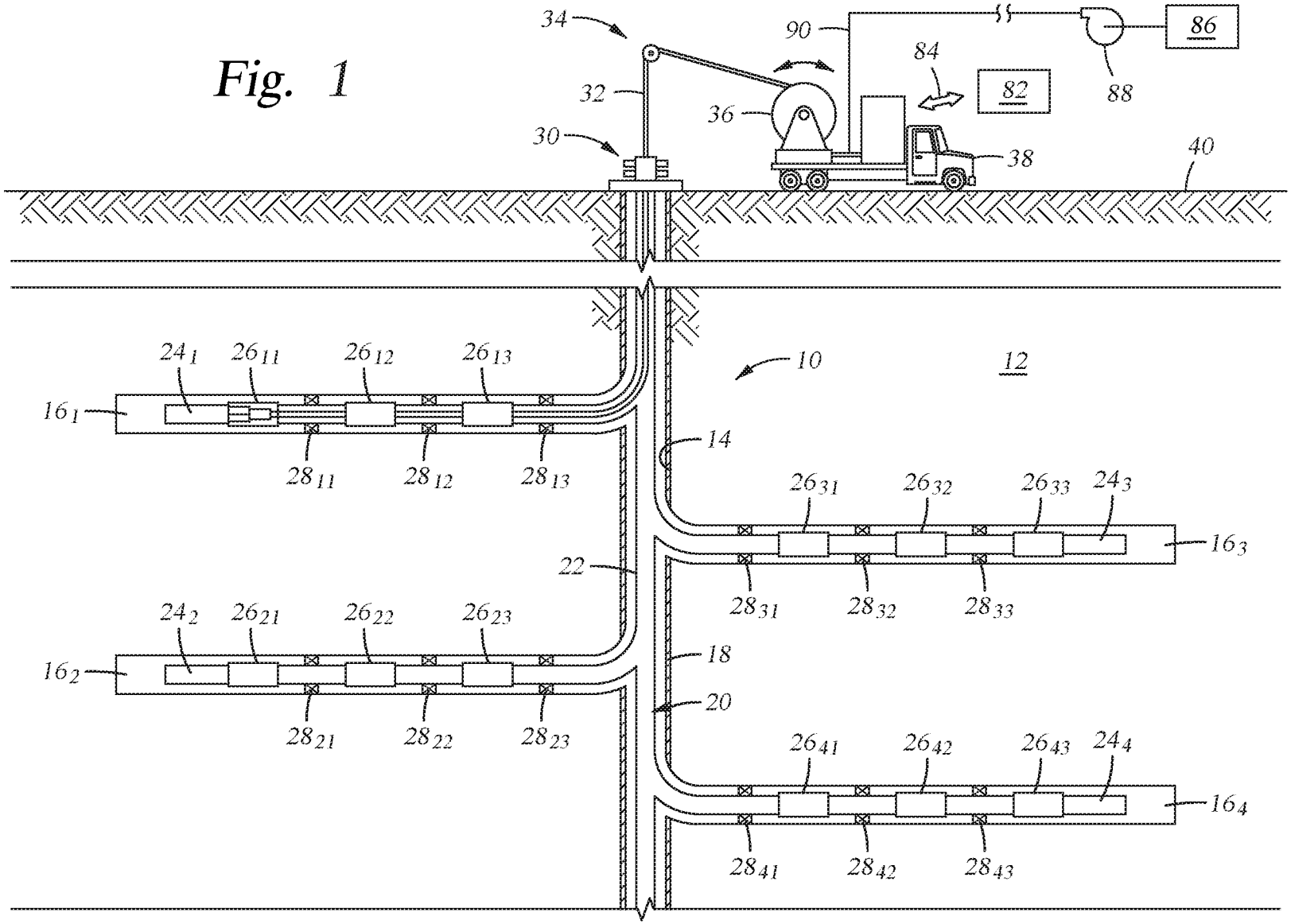
FIG. 1 is a side partial sectional view of an example of a downhole operation in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in partial side section view in FIG. 1 is an example of a wellbore circuit 10 formed into a subterranean formation 12. The wellbore circuit 10 includes a main bore 14 which in the example is substantially vertical and non-deviated, and lateral bores $\mathbf{16}_{1\text{-}4}$ that project radially outward from the main bore 14. In this example, casing 18 lines the main bore 14, whereas lateral bores $\mathbf{16}_{1\text{-}4}$ are not lined with casing, and are referred to herein as open hole. Further in the example of FIG. 1, a production tubing circuit 20 is installed within wellbore circuit 10, and which includes a main production line 22 installed within main bore 14, and production tubing legs $\mathbf{24}_{1\text{-}4}$ set respectively in lateral wells $\mathbf{16}_{1\text{-}4}$. Examples of inflow control valves ("ICDs") $\mathbf{26}_{11}$, $\mathbf{26}_{12}$, $\mathbf{26}_{13}$ are depicted in the production tubing leg $\mathbf{24}_1$. Similarly, ICDs $\mathbf{26}_{21}$, $\mathbf{26}_{22}$, $\mathbf{26}_{23}$ are in production tubing leg $\mathbf{24}_2$, ICDs $\mathbf{26}_{31}$, $\mathbf{26}_{32}$, $\mathbf{26}_{33}$ are in production tubing leg $\mathbf{24}_3$, and ICDs $\mathbf{26}_{41}$, $\mathbf{26}_{42}$, $\mathbf{26}_{43}$ are in production tubing leg $\mathbf{24}_4$. Packers $\mathbf{28}_{11}$, $\mathbf{28}_{12}$, $\mathbf{28}_{13}$ are set respectively between adjacent ICDs $\mathbf{26}_{11}$, $\mathbf{26}_{12}$, $\mathbf{26}_{13}$ of production tubing leg $\mathbf{24}_1$. Similarly, packers $\mathbf{28}_{21}$, $\mathbf{28}_{22}$, $\mathbf{28}_{23}$ are set respectively between adjacent ICDs $\mathbf{26}_{21}$, $\mathbf{26}_{22}$, $\mathbf{26}_{23}$, packers $\mathbf{28}_{31}$, $\mathbf{28}_{32}$, $\mathbf{28}_{33}$ are set respectively between ICDs $\mathbf{26}_{31}$, $\mathbf{26}_{32}$, $\mathbf{26}_{33}$, and packers $\mathbf{28}_{41}$, $\mathbf{28}_{42}$, $\mathbf{28}_{43}$ are set respectively between adjacent ones of the ICDs $\mathbf{26}_{41}$, $\mathbf{26}_{42}$, $\mathbf{26}_{43}$.

As illustrated in the example of FIG. 1, and as will be described in more detail below, the aforementioned ICDs provide selective flow control from formation 12 into one of the production legs $\mathbf{24}_{1\text{-}4}$. In the annuli between respective production legs $\mathbf{24}_{1\text{-}4}$ and lateral wells $\mathbf{16}_{1\text{-}4}$, isolation zones are formed by strategic placement of the aforementioned packers so that fluid in a particular isolation zone is directed to a single one of the ICDs. The combination of the ICDs and the packers form a system capable of controlling or blocking a flow rate of production fluid from a particular isolation zone into the production tubing circuit 20. Examples exist where controlling the flow rate of production fluid reduces influx of an undesired fluid (such as water), increases an influx of a desirable fluid (such as a hydrocarbon), and introduces a pressure drop across an ICD to balance pressure and/or flow in the production tubing circuit 20. In further examples, the combination of the ICDs and packers in the wellbore circuit 10 prevent flow from a particular zone from entering another zone in the formation 12.

In an embodiment, the wellbore circuit 10 further includes a wellhead assembly 30, an example of which is schematically illustrated in FIG. 1 mounted over an opening of the main bore 14. A string of coiled tubing 32 is shown inserted into wellbore circuit 10 and through wellhead assembly 30. The coiled tubing 32 is part of an intervention system 34, which as described in more detail below is selectively deployed for manipulating the ICDs. A portion of coiled tubing 32 outside of wellbore circuit 10 is shown wound on a reel 36, which in an example of operation generates forces for inserting the coiled tubing 32 downhole, or for withdrawing the coiled tubing 32 from within the wellbore circuit 10. In this example, reel 36 is mounted to a service truck 38 shown outside of wellbore circuit 10 and on surface 40.

Figure 2:
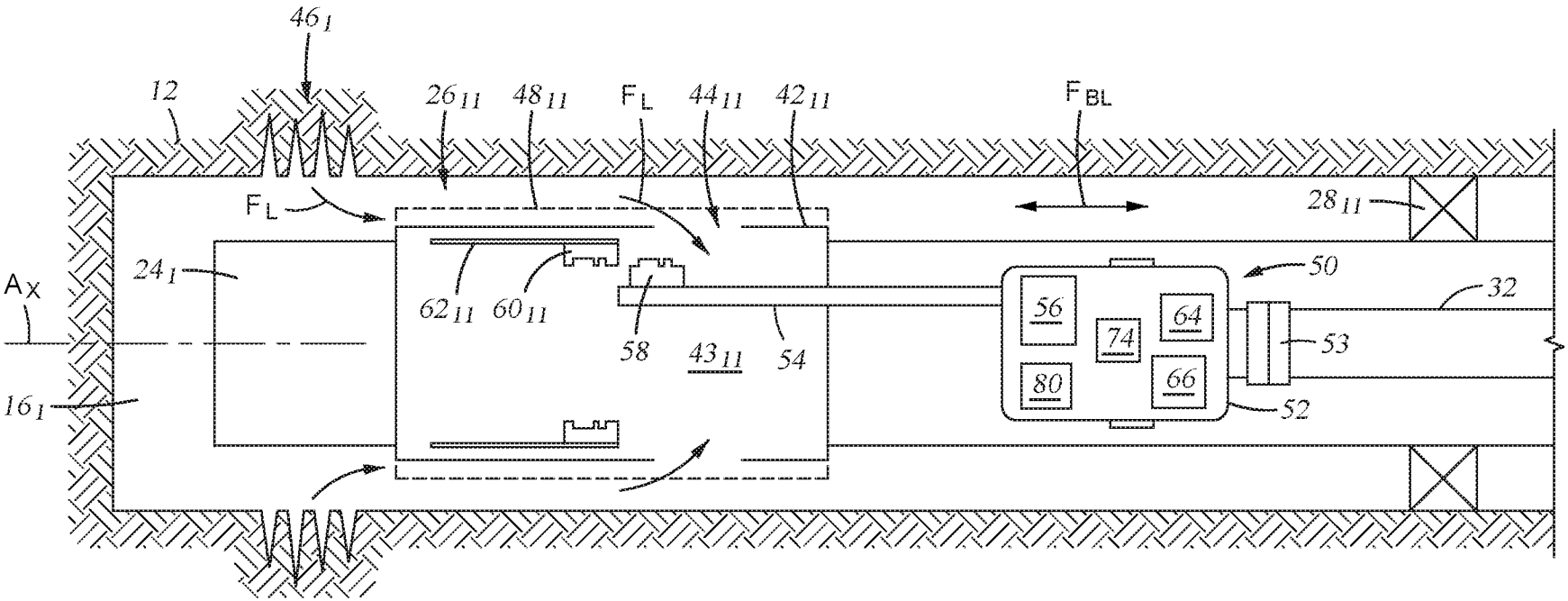
FIG. 2 is a side partial sectional view of a leg of production tubing of the wellbore of FIG. 1 having a bottom-hole assembly and an inflow control device.

Depicted in side sectional view in FIG. 2 is a schematic example of a well intervention operation in which ICD $\mathbf{26}_{11}$ is being manipulated. ICD $\mathbf{26}_{11}$ of FIG. 2 includes an annular body $\mathbf{42}_{11}$ shown having opposing ends integrally mounted within production tubing leg $\mathbf{24}_1$. A chamber $\mathbf{43}_{11}$ extends axially through body $\mathbf{42}_{11}$ that circumscribes axis $A_X$ of lateral well $\mathbf{16}_1$, and is in fluid communication with production tubing leg $\mathbf{24}_1$. A port $\mathbf{44}_{11}$ is formed radially through a sidewall of body $\mathbf{42}_{11}$ so that chamber $\mathbf{43}_{11}$ is in communication with lateral well $\mathbf{16}_1$ through port $\mathbf{44}_{11}$. The communication between chamber $\mathbf{43}_{11}$ and lateral well $\mathbf{16}_1$ allows for a flow of fluid $F_L$, illustrated by the curved arrows, to flow from perforations $\mathbf{46}_1$ formed radially outward into formation 12 from lateral wellbore $\mathbf{16}_1$. An optional screen $\mathbf{48}_{11}$ circumscribes body $\mathbf{42}_{11}$, and which provides a way to block or capture solid particles within the flow of fluid $F_L$, such as sand or rock particles.

Shown adjacent the ICD $\mathbf{26}_{11}$ is a bottom-hole assembly 50, which is deployed into the production tubing leg $\mathbf{24}_1$ on an end of the coiled tubing 32. A housing 52 is included as part of the bottom-hole assembly 50 and which connects to a lower end of the coiled tubing 32. In this example housing 52 is attached to coiled tubing 32 by a coupling 53, which is shown as a flange type connection; however, other embodiments exist where housing 52 is attached or otherwise engaged to a lower end of coiled tubing 32 by any other type of coupling such as threaded, welded, and the like. An elongated latching arm 54 is shown projecting from a side of housing 52 opposite tubing 32. A motor 56 is schematically illustrated within housing 52, which in a non-limiting example of operation exerts forces to latching arm 54 to selectively move latching arm 54 into designated positions and orientations; and also selectively exerts forces to latching arm 54 for manipulating ICD $\mathbf{26}_{11}$. An actuating profile 58 is shown on an end of actuating arm 54 distal from housing 52; which in an example is a pattern of depressions and projections that corresponds to a similar pattern of depressions and projections that define an ICD profile $\mathbf{60}_{11}$. In the example of FIG. 2, ICD profile $\mathbf{60}_{11}$ is disposed on an inner surface of an annular sleeve $\mathbf{62}_{11}$; which in in the embodiment illustrated is an annular member inside bore $\mathbf{43}_{11}$ and within body $\mathbf{42}_{11}$. Further in this example, annular sleeve $\mathbf{62}_{11}$ is selectively slideable within body $\mathbf{42}_{11}$ in an axial direction and along axis $A_X$. As described in more detail below, strategic positioning of sleeve $\mathbf{62}_{11}$ alters a flow configuration of the ICD $\mathbf{26}_{11}$. In the example of the flow configuration of FIG. 2, the ICD $\mathbf{26}_{11}$ is in a full flow configuration so that all of the cross-section of the port $\mathbf{44}_{11}$ is fully exposed to the chamber $\mathbf{43}_{11}$.

Figure 3:
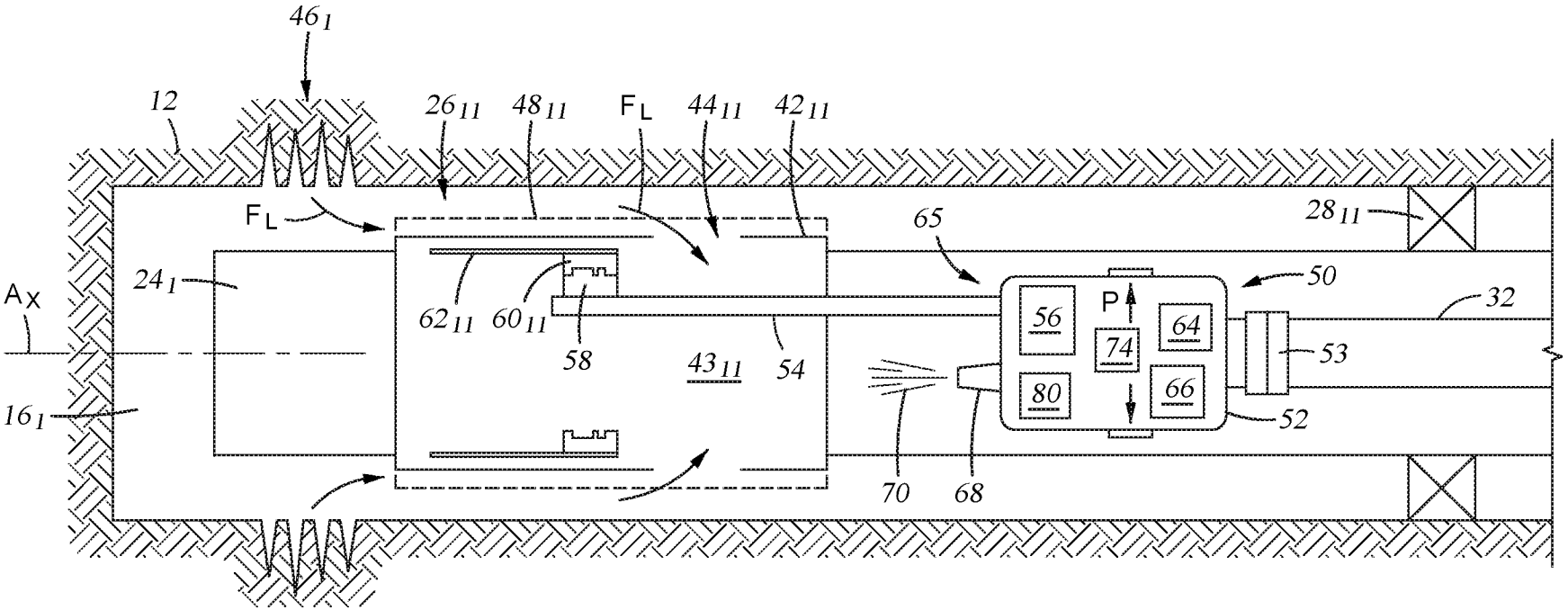
FIG. 3 is a schematic example of the bottom-hole assembly of FIG. 2 engaging the inflow control device.

Referring now to FIG. 3, latching arm 54 is shown having been manipulated by actuation of motor 56 so that actuator profile 58 is engaged with ICD profile $\mathbf{60}_{11}$. A controller 64 is schematically illustrated within housing, and which in one example provides operational instructions to motor 56, which result a response by motor 56 to position actuator arm 54 into a designated configuration, such as engagement of profile 85 with ICD profile $\mathbf{60}_{11}$. In one embodiment, the combination of the motor 56, actuator arm 54, actuator profile 58, and controller 64 define an actuator system 65. Schematically represented within housing 52 and included with bottom-hole assembly 50 is an optional monitoring system 66, which provides selective sensing of ambient conditions within tubing $\mathbf{24}_1$ such as pressure, temperature, and depth. In another non-limiting example of operation, communication between monitoring system 66 and controller 64 selectively triggers actuation of certain instructions for operation of bottom-hole assembly 50.

Also included in the example of FIG. 3 is an optional nozzle 68 shown mounted on housing 52, and which is in communication with an inner bore of the coiled tubing 32. A fluid 70 is shown being discharged from an open end of nozzle 68 and into the production tubing leg $\mathbf{24}_1$. Examples exist where the fluid 70 is applied for conditioning formation 12, and examples of fluid include an acid, brine, diesel, and any other fluid used in treating a wellbore. In an example, lines for power, communication or control are not inserted within coiled tubing 32; so that a bore 71 inside the coiled tubing 32 contains only the fluid 70. Advantages of reserving the bore 71 for the fluid 70 maximizes a flow rate of the fluid 70 being delivered into the production tubing leg $\mathbf{24}_1$. Another advantage exists that any interaction between potentially corrosive fluids, such as acid, and the lines in the bore 71.

Figure 4:
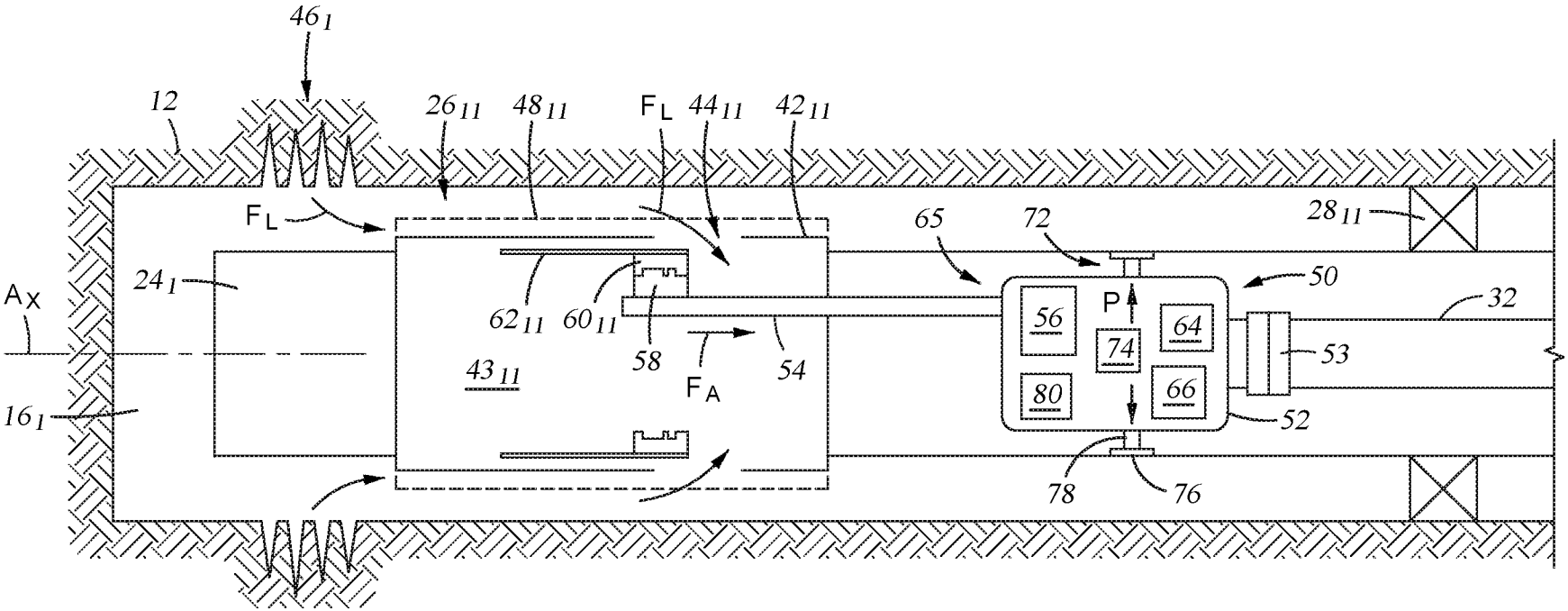
FIG. 4 is a schematic example of the bottom-hole assembly of FIG. 2 manipulating the inflow control device into a flow control configuration.

Referring now to FIG. 4, in a non-limiting example of operation actuating arm 54 is shown having been manipulated by motor 56 so that the actuator profile 58 is put into engagement with ICD profile $\mathbf{60}_{11}$. Further in this example, surface areas of the protrusions and depressions of the respective profiles 58, $\mathbf{60}_{11}$, in combination with material properties of profiles 58, $\mathbf{60}_{11}$, form surfaces of interfering contact having adequate structural integrity to transfer a force or forces from the actuating arm 54 to the sleeve $\mathbf{62}_{11}$ of sufficient magnitude to move the sleeve $\mathbf{62}_{11}$ within the body $\mathbf{44}_{11}$. In an example, an actuating force $F_A$, which is schematically illustrated by an arrow, represents a force transferred from actuating arm 54 to sleeve $\mathbf{62}_{11}$, and having sufficient magnitude to move sleeve $\mathbf{62}_{11}$ within body $\mathbf{44}_{11}$. Further in the example, actuating force $F_A$ draws sleeve $\mathbf{62}_{11}$ axially and along an axis $A_X$ of lateral well $\mathbf{16}_1$. As depicted in FIG. 4, sleeve $\mathbf{62}_{11}$ is drawn adjacent to a portion of port $\mathbf{44}_{11}$ by the actuation force $F_A$ to block communication through that portion of port $\mathbf{44}_{11}$; blocking communication through that portion restricts the area for which fluid $F_L$ may flow into production tubing leg $\mathbf{24}_1$. For the purposes of illustration, ICD $\mathbf{26}_{11}$ is put into a flow control configuration by positioning the sleeve $\mathbf{62}_{11}$ adjacent to the portion of port $\mathbf{44}_{11}$.

Referring back to FIG. 2, actuating arm 54 is shown free from ICD $\mathbf{26}_{11}$ and not engaged with other devices in the well circuit 10. A baseline force $F_{BL}$ as illustrated by arrow, represents a force applied to the coiled tubing 32 to effectuate axial movement within production tubing leg $\mathbf{24}_1$ of coiled tubing 32 and bottom-hole assembly 50 alone. In a non-limiting example, a magnitude of baseline force $F_{BL}$ is obtained by monitoring the force necessary for the axial movement of bottom-hole assembly 50 and attached coiled tubing 32. Further in this example, a confirmation that the actuating arm 54 is engaged with the sleeve $\mathbf{62}_{11}$ via their respective profiles 54, $\mathbf{62}_{11}$ is established by comparing a magnitude of a previously recorded baseline force $F_{BL}$ with a magnitude of a force currently being applied to the coiled tubing 32. In an example of operation, moving coiled tubing 32 and bottom-hole assembly 50 within well circuit 10 and when profiles 54, $\mathbf{62}_{11}$ are engaged, requires a force with a magnitude greater than that of the baseline force $F_{BL}$; and confirmation of engagement between the profiles 54, $\mathbf{62}_{11}$ is obtained by comparing these magnitudes of force.

Referring back to FIG. 4, schematically illustrated is an example of anchors 72 in a deployed configuration, and in anchoring engagement with an inner surface of the production tubing leg $\mathbf{24}_1$. This is in contrast to the retracted configuration of the anchors 72 depicted in FIGS. 2 and 3 where each anchor 72 is spaced radially inward from sidewalls of inner tubing leg $\mathbf{24}_1$. Optionally, an anchor motor 74 is used for deploying and setting anchor 72, and which is illustrated disposed within housing 52. In one embodiment, anchor 72 is made up of pads 76 that are shown engaged with the inner surface of production tubing leg $\mathbf{24}_1$ and that mount on pins 78 which project radially outward from housing 52. Engagement of the production tubing leg $\mathbf{24}_1$ by anchors 72 is by a force that is directed radially outward from housing 52 through pins 78 and pads 76 and along path P. Urging pads 76 against production tubing leg $\mathbf{24}_1$ generates a resistive anchoring force $F_R$ shown oriented in a direction parallel to actuating force $F_A$. An advantage of the anchors 72 is that the magnitude of the resistive force $F_R$ produced by the deployment of anchors 72 is at least that of the actuating force $F_A$. In a non-limiting example of operation, engaging production tubing leg $\mathbf{24}_1$ with anchors 72 diverts reactive forces resulting from actuating the ICD $\mathbf{26}_{11}$ away from the coiled tubing 32 and onto the production tubing leg 24. An advantage of redirecting or absorbing these forces is that it avoids the risk of buckling the coiled tubing 32 or other failure mode deformations that can occur when transmitting forces axially through coiled tubing for operation or manipulation of an inflow control device.

Figure 5:
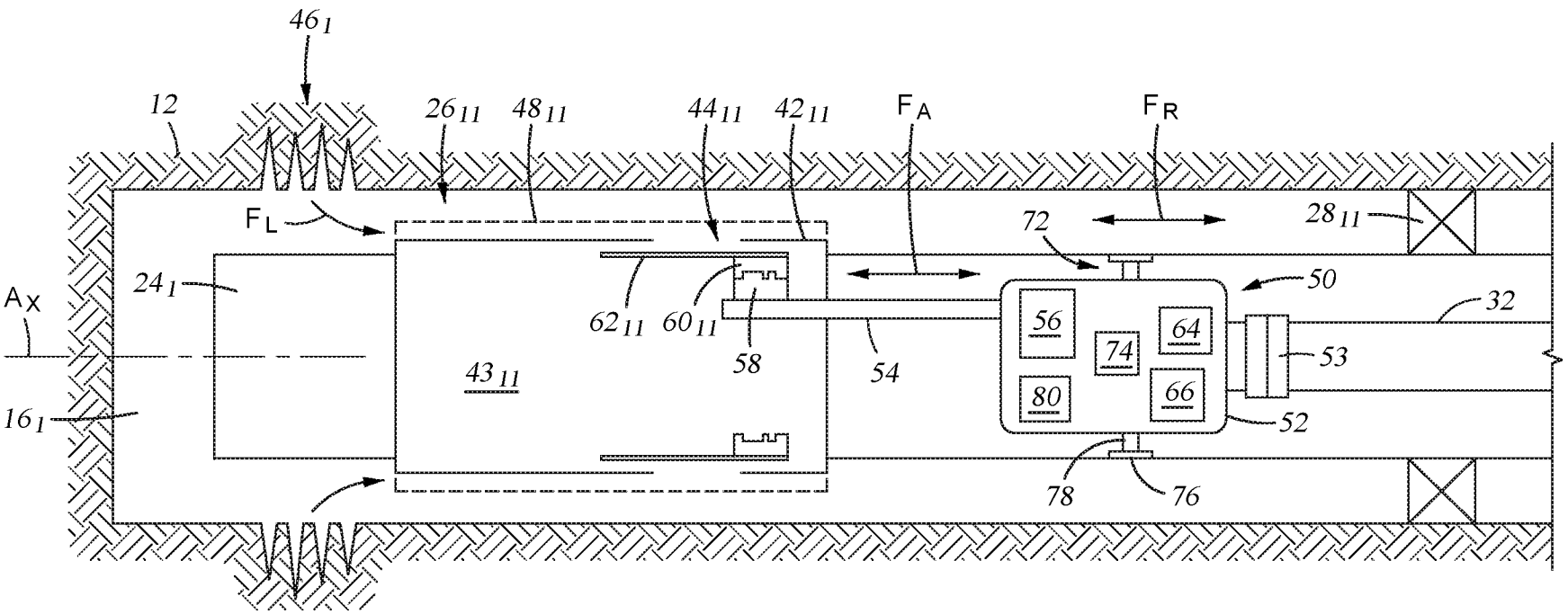
FIG. 5 is a schematic example of the bottom-hole assembly of FIG. 2 manipulating the inflow control device into a closed configuration.

Referring now to FIG. 5, shown in a side sectional view is a schematic example of the ICD $\mathbf{26}_{11}$ configured into a closed configuration with sleeve $\mathbf{62}_{11}$ positioned within bore $\mathbf{43}_{11}$ and adjacent the entirety of port $\mathbf{44}_{11}$ so there is no communication through port $\mathbf{44}_{11}$. In a non-limiting example of operation, sleeve $\mathbf{62}_{11}$ is moved into the position of FIG. 5 directly from the flow control configuration of FIG. 4; directly from the open configuration of FIG. 2, or from another position. In the example of FIG. 5, sleeve $\mathbf{62}_{11}$ is moved into the position shown in response to actuating force $F_A$ in the manner described above. In the closed configuration, fluid $F_L$ exiting perforations $\mathbf{46}_1$ is blocked from entering the chamber $\mathbf{43}_{11}$ by the presence of sleeve $\mathbf{62}_{11}$ adjacent all of port $\mathbf{44}_{11}$.

In an alternative example of operation manipulation of the ICD $\mathbf{26}_{11}$ is performed with the intervention system 34 of FIG. 1, and where downhole assembly is moved adjacent to ICD $\mathbf{26}_{11}$ when in a closed configuration, and the profiles 58, $\mathbf{60}_{11}$ are then engaged similar to the method described above, and an actuating force $F_A$ is applied to sleeve $\mathbf{62}_{11}$ to reconfigure the ICD $\mathbf{26}_{11}$ into a flow control configuration or optionally a full flow or open configuration. Schematically representing the direction of actuating force $F_A$ and resistive force $F_R$ are the double-headed arrows shown in FIG. 5, and depicting how a direction of the reactive force $F_R$ changes with that of actuating force $F_A$, and which again diverts any forces resulting from actuating force $F_A$ away from the coiled tubing 32.

An alternative, a power source 80 is shown included within housing 52 in FIGS. 2 through 5, and which is selectively used for powering one or both of motor 56 and motor 74. Non-limiting examples of power source 80 include stored energy in the form of electricity or pressurized fluid, as well as a method of transferring energy from fluid flowing within coiled tubing 32.

Referring back to FIG. 1, a controller 82 is shown on surface 40 and which is selectively used to generate and/or provide instructive signals downhole as well as receive signals from bottom-hole assembly 50. A communication means 84 is depicted that optionally provides a way for controller 82 to be in communication with bottom-hole assembly 50. Examples of communication means 84 include wireless telemetry, mud pulses, or fiber optics. In an alternative, fiber optic elements are included with tubing 32 to provide communication between surface 40 and within the wellbore circuit 10. In an alternative, a fluid source 86 is shown in FIG. 1 which is delivered downhole by communication to service 38 truck and coiled tubing 32 via line 88. An optional pump 90 provides pressurization for fluid in the fluid source 86 to be delivered into coiled tubing 32.

In a non-limiting example of operation of the intervention system 34, bottom-hole assembly 50 is deployed into the wellbore circuit 10 on an end of coiled tubing 32. A force is applied to further insert coiled tubing 32 into wellbore circuit 10, such as from reel 36, to urge bottom-hole assembly 50 adjacent to a designated location within wellbore circuit 10; such as adjacent to ICD $\mathbf{26}_{11}$ inside production tubing leg $\mathbf{24}_1$. Optionally, bottom-hole assembly 50 is urged adjacent to ICD $\mathbf{26}_{12}$ or $\mathbf{26}_{13}$, or to any of the other ICDs in the other production tubing legs $\mathbf{24}_{2\text{-}4}$. Alternatives exist where bottom-hole assembly 50 is urged through one or more uphole ICDs to be positioned adjacent to a downhole ICD in a particular production tubing leg. Further optionally, a steering arm (not shown) or other steering system is included with the intervention system 34 for directing the bottom-hole assembly 50 into a designated one of the production tubing legs $\mathbf{24}_{1\text{-}4}$. Further in this example, operations are conducted with the intervention system 34 the same or similar to that described above to manipulate ICD $\mathbf{26}_{11}$. Alternative actions after completing a designated manipulation of ICD $\mathbf{26}_{11}$ include moving the bottom-hole assembly 50 away from the ICD $\mathbf{26}_{11}$ by applying a force to coiled tubing 32. Optional destinations for the bottom-hole assembly 50 include adjacent to another ICD in the production tubing circuit 20 and where manipulation of another ICD is conducted, and outside of the wellbore circuit 10. Further in this example, the bottom-hole assembly 50 is withdrawn from the wellbore circuit 10, or repositioned to a lesser depth inside the wellbore circuit 10 applying a force to the coiled tubing 32 in a direction substantially opposite when inserting or lowering the bottom-hole assembly 50 in the wellbore circuit 10.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. An intervention system for use in a wellbore comprising:

coiled tubing selectively inserted within production tubing disposed in the wellbore; and a bottom-hole assembly that is selectively moveable adjacent to an inflow control device coupled with the production tubing and that comprises, a housing coupled with coiled tubing, an elongated arm comprising and end coupled with the housing, and a profiled portion on an opposite end that is distal from the housing that is selectively moved with respect to the housing and into engagement with a profile on the inflow control device, and an anchor coupled with the housing that is selectively engaged with sidewalls of the production tubing to define a path along which a force resulting from engagement between the profiled portion of the arm and the profile on the inflow control device is transferred.

2. The intervention system of claim 1, further comprising a nozzle having an inlet in communication with the coiled tubing, and an exit in communication with the inflow control device to define a fluid flow path between the coiled tubing and the inflow control device.

3. The intervention system of claim 1, wherein the housing further comprises a motor that is coupled to the arm, so that when the motor is energized the profiled portion of the arm is selectively moved into engagement with the profile on the inflow control device.

4. The intervention system of claim 3, wherein the inflow control device comprises a body, a valve member moveable within the body, and a port formed radially through a side wall in the body, wherein the profile on the inflow control device is formed on the valve member, and wherein an inside of the production tubing is in fluid communication with sidewalls of the wellbore through the port.

5. The intervention system of claim 4, wherein the inflow control device is in an open configuration when the valve member is spaced away from the port, wherein the inflow control device is in a flow control configuration when the valve member is set adjacent a portion of the port, wherein the inflow control device is in a closed configuration when the valve member is adjacent all of the port, and wherein the inflow control device is selectively moved between each of the open, flow control, and closed configurations by energizing the motor.

6. The intervention system of claim 1, wherein the housing further comprises an anchor motor that is coupled to the anchor, so that when the motor is energized the anchor is selectively moved into anchoring engagement with the sidewalls of the production tubing.

7. The intervention system of claim 1, wherein the bottom-hole assembly further comprises a power source in the housing that selectively provides energy used to actuate the arm and the anchor.

8. The intervention system of claim 1, wherein a portion of the coiled tubing distal from the housing mounts to a reel disposed outside of the wellbore.

9. The intervention system of claim 1, wherein disengaging the profiled portion of the arm with the profile on the inflow control device frees the bottom-hole assembly to move within and out of the wellbore.

10. An intervention system for use in a wellbore comprising:

coiled tubing having a deployed end selectively inserted into production tubing that is installed within the wellbore;

a housing attached to the deployed end;

an actuator coupled with the housing and comprising a portion indented with a pattern to define an actuator profile that is selectively engaged with an inflow control device profile; and an anchor coupled with the housing and that is selectively moved between a retracted configuration adjacent the housing, and a deployed configuration radially outward from the housing and into anchoring engagement and in direct contact with an inner surface of the production tubing.

11. The intervention system of claim 10, further comprising a monitoring system in the housing that is responsive to conditions in the wellbore that include temperature, pressure, and depth.

12. The intervention system of claim 10, wherein the actuator profile is changeable to correspond to the inflow control device profile.

13. A method of intervening in a wellbore comprising:

handling an intervention system having a portion disposed inside of production tubing that is inserted in the wellbore, the intervention system comprising a string of coiled tubing, and a bottom-hole assembly that is attached to the coiled tubing;

adjusting a flow configuration of an inflow control device coupled with the production tubing with the bottom-hole assembly; and isolating the coiled tubing from a force resulting from the step of adjusting by securing the bottom-hole assembly to the production tubing.

14. The method of claim 13, wherein the force comprises a resultant force, and wherein adjusting a flow configuration of an inflow control device comprises engaging complementary profiles on the bottom-hole assembly and inflow control device, and applying an adjustment force from the bottom-hole assembly to the inflow control device so that a flow of fluid through the inflow control device is adjusted.

15. The method of claim 14, wherein the adjustment force is generated within the bottom-hole assembly.

16. The method of claim 13, further comprising conditioning the wellbore by discharging fluid from a nozzle mounted on the bottom-hole assembly, wherein the fluid flows downhole inside the coiled tubing.

17. The method of claim 16, wherein the fluid that flows downhole inside the coiled tubing comprises acid.

18. The method of claim 16, wherein a cross section of a bore inside the coiled tubing is filled entirely with the fluid.

19. The method of claim 13, wherein the inflow control device comprises a first inflow control device, the method further comprising moving the bottom-hole assembly to a location in the production tubing that is spaced away from the first inflow control device and adjacent to a second inflow control device, engaging the second inflow control device with the bottom-hole assembly, and adjusting a flow configuration of the second inflow control device.

20. The method of claim 19, wherein the step of moving the bottom-hole assembly comprises manipulating the coiled tubing.

* * * * *